United States Patent [19]

Brundage

[11] 3,955,672

[45] May 11, 1976

[54] PLATE ASSEMBLY

[76] Inventor: Keene N. Brundage, 13827 Sunset Drive, Whittier, Calif. 90602

[22] Filed: Feb. 28, 1975

[21] Appl. No.: 554,199

[52] U.S. Cl. ..... 206/72; 220/8; 220/23.86; 224/48 R; 229/2.5 R

[51] Int. Cl.[2] ..... B65D 1/36; A47G 23/06

[58] Field of Search ..... 229/2.5; 224/48 C, 48 R; 206/72; 220/8, 23.83, 23.86

[56] References Cited

UNITED STATES PATENTS

| | | | |
|---|---|---|---|
| 2,314,935 | 3/1943 | Gutterman | 206/72 |
| 2,561,022 | 7/1951 | Jones | 229/2.5 |
| 2,880,902 | 4/1959 | Owsen | 220/8 |
| 3,285,459 | 11/1966 | Gahm | 220/8 |
| 3,504,832 | 4/1970 | Corvetti | 206/72 |
| 3,850,333 | 11/1974 | Reichert | 220/23.8 |

*Primary Examiner*—William Price
*Assistant Examiner*—Bruce H. Bernstein
*Attorney, Agent, or Firm*—Lyon & Lyon

[57] ABSTRACT

There is disclosed herein a plate assembly comprised of a body and a cup support member integrally formed with the body. The body is provided with a channel which functions to receive the forearm of the user for support of the plate assembly. The cup support member protrudes into the interior of the channel and functions as a grasping means for balancing the plate assembly when it is positioned on the forearm of the user.

6 Claims, 3 Drawing Figures

PLATE ASSEMBLY

BACKGROUND OF THE INVENTION

The present invention relates to a food serving plate assembly and, in particular, a plate assembly having means formed therein for supporting and balancing the plate on the forearm of the user.

Several types of food serving plates or trays are known in the art. One of the prior food serving trays is disclosed in U.S. Design Pat. No. 116,623. The patent discloses a baby's dining tray comprised of a base having recessed portions for receipt of a cup and a serving plate. The serving plate is provided with a plurality of separate food-bearing compartments. The tray is not, however, provided with means for supporting or balancing the tray on the arm of the user.

The British Pat. No. 462,472, discloses a prior serving tray comprised of a carrying surface, a frame having recesses formed in the base thereof and a support handle connected to the base of the frame. When in use, the tray is supported by placing the forearm of the user into one of the recesses and securely grasping the support handle. The tray is intended to be used as a means for transporting food-bearing plates. The carrying surface of the tray is not intended to be used as a food-bearing surface nor is the carrying surface provided with separate compartments for receiving food. Furthermore, the tray is designed to be capable of transporting several plates and therefore is too large and cumbersome to be used for individual servings.

Another food serving plate is disclosed in U.S. Design Pat. No. 91,229. The patent discloses a plate comprised of a base member having a food serving compartment and an upstanding support member which functions both as a handle and a means for supporting a cup. The plate is not, however, capable of being supported or balanced on the arm of the user.

SUMMARY OF THE INVENTION

It is therefore an object of the present invention to provide a food serving plate which is capable of being supported and balanced on the arm of the user.

These and other objects and advantages are obtained by utilizing a plate assembly comprised of a body having a food-bearing surface, a support surface and a cup support member integrally formed with the body. The body is provided with an upstanding ridge which functions to divide the food-bearing surface of the plate into a plurality of separate compartments and forms a corresponding channel in the support surface. When in use, the channel functions to receive the forearm of the user for support of the plate assembly. The integrally formed cup support member protrudes into the interior of the channel and functions as a grasping means for balancing the plate assembly. The cup support member also functions to receive and support a glass or can of liquid. The member preferably does not protrude below the plane defined by the support surface thereby enabling the level positioning of the plate assembly.

The plate assembly enables the user to support and balance a plate of food and a glass of liquid on one arm easily and safely without danger of spillage thereby permitting the individual to use the other hand in eating and drinking. The plate assembly can be used at parties or other ocassions where people are unable to rest their plates and glasses on a flat stable surface.

BRIEF DESCRIPTION OF DRAWINGS

A more thorough disclosure of the objects and advantages of the present invention is presented in the detailed description which follows and from the accompanying drawings in which.

DETAILED DESCRIPTION OF THE INVENTION

Figure 1:
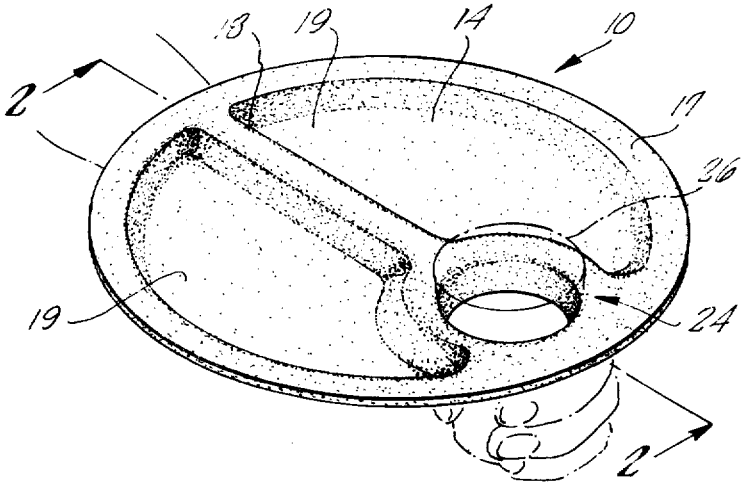
FIG. 1 is a perspective view of the plate assembly resting on the arm of the user.
Figure 2:
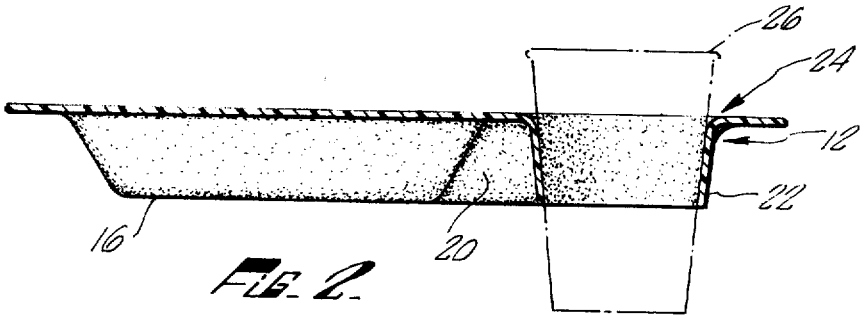
FIG. 2 is a cross-section of the plate assembly taken along line 2—2 of FIG. 1.

The drawings illustrate the preferred embodiment of a plate assembly according to the present invention. Referring to FIGS. 1 and 2, there is shown a plate assembly comprising generally a body 10 and an integrally formed cup support member 12. The body is provided with a food-bearing surface 14, a support surface 16 and a rim 17. A transverse upstanding ridge 18 is formed in body 10 and serves to divide the food-bearing surface of the plate assembly into a plurality of separate compartments 19. The upstanding ridge 18 forms a corresponding channel 20 in support surface 16 of body 10. When in use, channel 20 functions to receive the forearm of the user for support of the plate assembly. The channel is preferably tapered outwardly to permit a more comfortable fit on the arm of the user. Channel 20 is also preferably formed with sufficient width to enable both right-handed and left-handed people to use the assembly.

The cup support member 12 is comprised of column 22 and lip 24. Lip 24 is integrally formed with rim 17 and ridge 18. Column 22 protrudes into the interior of channel 20 but preferably does not protrude below the plane defined by support surface 16 thereby enabling the level positioning of the plate assembly. The cup support member functions as a grasping means to enable the user to balance the plate while it is resting on the user's forearm. It is preferred that column 22 be tapered slightly inwardly to facilitate grasping of the column and to enable the stacking of a plurality of plate assemblies. The column 22 may also be provided with corrugations to facilitate grasping. The cup support member also functions to receive glass 26. When inserted into member 12, glass 26 protrudes below column 22 and functions to provide additional grasping area to facilitate in balancing the plate assembly on the forearm of the user. The glass may, however, be removed without loss of balance of the plate.

Figure 3:
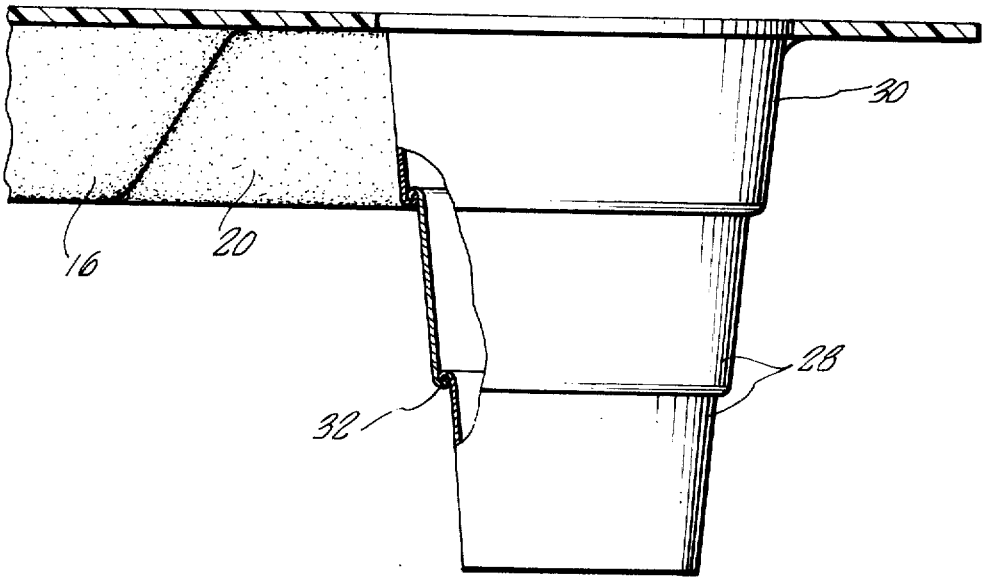
FIG. 3 is a fragmentary view of an alternate embodiment of the plate assembly.

Referring to FIG. 3, there is shown an alternate embodiment of a cup support member. In the alternate embodiment the cup support member is preferably comprised of a plurality of collapsible sections 28 and 30 which are preferably telescopically interfitted. The sections are preferably frustrum-shaped and are provided with flanges 32. The flanges 32 function to support the individual sections when the cup support member is extended. Preferably the first section 30 protrudes into channel 20 to the same depth as support surface 16. Preferably the cup support member is comprised of three or four sections each having a height of approximately ½ of an inch. When in use, the sections are telescopically extended thereby providing a grasping means for balancing of the plate assembly. When not in use, the plate assembly may be rested on a flat surface by urging sections 28 into the interior of section 30.

It is also possible to form a plate assembly with a detachable cup support member. When it is not necessary to provide means for supporting a glass, a telescoping plug integrally formed with the body of the plate may be substituted for the cup support member. The plate is preferably made of plastic or paper such as cardboard, but, it will be obvious to one skilled in the art, that other suitable materials may also be used.

To utilize the plate assembly, channel 20 is first positioned over the forearm of the user. The user then grasps the cup support member 12 to securely balance the plate assembly on the forearm. The user may now place food onto the food bearing surface of the plate and a glass 26 into the cup support member 12. The glass 26 may be removed without releasing the grasp on the support member 12 and without loss of the balance of the plate.

While embodiments and applications of this invention have been shown and described, it would be apparent to those skilled in the art that many more modifications are possible without departing from the inventive concept herein described. The invention, therefore, is to be limited only by the lawful scope of the claims which follow.

I claim:

1. A plate assembly capable of being supported and balanced on the forearm of the user comprising:

a body having a food bearing surface and a support surface, said support surface having a channel formed therein for receipt of the forearm of the user; and a cup support member integrally formed with said body and protruding into said channel to the plane defined by said support surface to enable level positioning of said assembly on a flat surface, said cup support member forming a grasping means for balancing the plate assembly when it is resting on the forearm of the user and said support member being open at both ends.

2. The plate assembly of claim 1 wherein said cup support member consists of a plurality of collapsible sections.

3. The plate assembly of claim 2 wherein said sections are telescopically interfitted and provided with flanges.

4. The plate assembly of claim 1 wherein said channel forms a corresponding ridge in said food bearing surface.

5. A plate assembly capable of being supported and balanced on the forearm of the user comprising:

a body having a food bearing surface and a support surface, said support surface having a channel formed therein for receipt of the forearm of the user; and a cup support member integrally formed with said body, said member consisting of a plurality of telescopically interfitted collapsible sections having flanges formed thereon.

6. A plate assembly capable of being supported and balanced on the forearm of the user comprising:

a body having a food bearing surface and a support surface, said support surface having a channel formed therein for receipt of the forearm of the user; and, a cup support member integrally formed with said body and protruding into said channel to a point not beyond the plane defined by said support surface to enable level positioning of said assembly on a flat surface, said cup support member forming a grasping means for balancing the plate assembly when it is resting on the forearm of the user and said support member being open at both ends.

* * * * *